United States Patent [19]

Fatton

[11] 4,335,453

[45] Jun. 15, 1982

[54] ELECTRONIC WATCH

[75] Inventor: Jean-Claude Fatton, Le Landeron, Switzerland

[73] Assignee: Ebauches Electroniques S.A., Marin, Switzerland

[21] Appl. No.: 151,780

[22] Filed: May 21, 1980

[30] Foreign Application Priority Data

Jun. 1, 1979 [CH] Switzerland ..... 5133/79

[51] Int. Cl.[3] ..... G04B 19/24; G04B 19/30; G04C 19/00

[52] U.S. Cl. ..... 368/30; 368/67; 368/71; 368/82

[58] Field of Search ..... 368/67, 69, 71, 82–84, 368/227, 239, 240–242, 224, 223, 80, 79, 70, 203, 204; 340/765, 784, 785

[56] References Cited

U.S. PATENT DOCUMENTS

| | | | |
|---|---|---|---|
| 3,864,905 | 2/1975 | Richardson | 368/67 |
| 3,911,665 | 10/1975 | Van Berkum | 368/82 |
| 3,991,552 | 11/1976 | Ho | 58/4 |
| 4,212,159 | 7/1980 | Noble et al. | 368/82 |
| 4,246,602 | 1/1981 | Sekita et al. | 368/71 |
| 4,277,840 | 7/1981 | Sekita et al. | 368/71 |

OTHER PUBLICATIONS

"LCD Watch Designed to Fit Thin Case", Electronics, 9/16/76, vol. 49, No. 19, pp. 8E, 10E.

*Primary Examiner*—Vit W. Miska
*Attorney, Agent, or Firm*—Silverman, Cass & Singer, Ltd.

[57] ABSTRACT

In an electronic watch the indication of the time (hours, minutes and possibly seconds) is given in analog form by means of a first passive electro-optic display cell. The display segments of this first display cell are arranged radially with respect to a central point, and the activated segments thereof have the appearance of the conventional hands of an analog watch. The watch comprises a second passive electro-optic display cell furnishing information in digital form, for example indicating the day of the week and the date. So that only the second cell need be provided with an illuminating device, the watch comprises a selector which is manually operable by means of a push-button which, when it is operated, causes the time to be displayed by the second cell at the same time as the illuminating device thereof is operated. This arrangement enables the user to know the time in the dark without it being necessary to provide the first cell with an illuminating device.

4 Claims, 3 Drawing Figures

ELECTRONIC WATCH

BACKGROUND OF THE INVENTION (a) Field of the invention

This invention relates to an electronic watch comprising two passive electro-optic display devices, the first of which displays the time in an analog mode whereas the other furnishes digital information.

(b) Description of the Prior Art

Such watches are known per se. A liquid crystal display device displaying time information in analog form comprises a display cell the size of which, seen in plan view, is larger than that of the display cell which provides the digital display. The digital display cell comprises a number of digits each constituted by seven display segments arranged in a figure "8" shape. As a matter of fact, the analog time display needs the display segments thereof to be arranged radially with respect to a central point so that their selective activation, rendering one or the other of the resultant radial rays contrasted with respect to the background of the cell, and consequently visible, gives the user the illusion that the watch has hands.

The illumination of such display cells, being of large dimensions, gives rise to problems due to the fact that it is difficult, in the case of large surfaces, to place under the display cell a light conducting member which does not jeopardize the quality of the daytime reading.

SUMMARY OF THE INVENTION

This invention solves this problem by enabling, for reading of the time in the dark, the time display to be transferred onto the second display device of the watch, which displays time digitally or numerically. The second display device is more readily provided with an illuminating device since it is constituted by a conventional passive electro-optic display cell comprising a number of display digits.

The various features of the invention will be apparent from the following description, drawings and claims, the scope of the invention not being limited to the drawings themselves as the drawings are only for the purpose of illustrating one way in which the principles of the invention can be applied. Other embodiments of the invention utilising the same or equivalent principles may be used and structural changes may be made as desired by those skilled in the art without departing from the present invention and the purview of the appended claims.

DESCRIPTION OF THE PREFERRED EMBODIMENT

Figure 1:
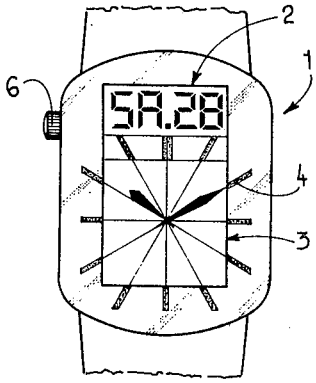
FIGS. 1 and 2 are plan views, respectively illustrating two different operational modes, of an electronic wrist-watch representing a preferred embodiment of the invention.

The watch as illustrated, in this example an electronic wrist-watch generally designated by the reference character 1, comprises two passive electro-optic display devices 2 and 3 each of which is a liquid crystal type display.

The display device 2 is a conventional display device, the display of which is digital or numeric, having four digits each of seven or eight segments arranged in a figure "8" shape. In the operational mode illustrated in FIG. 1, the first two digits serve for display of the two first letters of the names of the days of the week (Saturday in the illustrated example) while the last two digits serve for display of the days of the months (the 28th in the illustrated example).

Considering now the display device 3, it comprises a passive electro-optic display cell of square shape, comprising display segments arranged radially with respect to the center of the square. The display enables one or the other of the radial segments, and possibly several thereof, to be rendered contrasted, and hence visible so that they then appear as the conventional hands of a watch, indicating the time with respect to hours graduations 4 set out on the upper face of the watch, around the cell 3. Thus, the time (hours, minutes and possibly also seconds) is displayed in analog form, just as if displayed by means of conventional hands, in spite of the fact that the time display is produced by electro-optic means.

Since it is practically impossible to provide a passive electro-optic display cell of the dimension of the cell 3 with an illuminating device which does not jeopardize the quality of the daytime display, it is only the display cell 2 which has been provided with such a device. The illumination device has not been represented in the drawing otherwise than as symbolically at 5 in FIG. 3, since it can be of any known type. For example, it may be constituted by an incandescent lamp situated opposite the edge of a light diffusing member located behind the cell.

Figure 2:
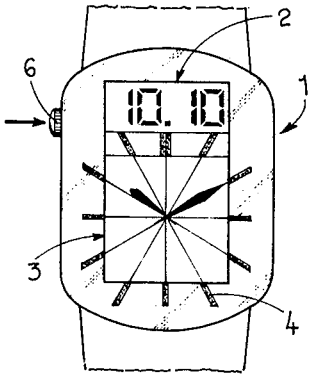

The watch includes a push-button switch 6 operating a selector 7 (FIG. 3) transferring the time display to the cell 2 which then ceases to display the day of the week and the date. At the same time the operation of the push-button 6 produces lighting of the lamp 5. As a result of this arrangement, the user of the watch can read the time even in the dark. The state of the watch when the pushbutton 6 has been operated is illustrated in FIG. 2, where the cell 2 displays the time "10 minutes after 10 o'clock" as does the cell 3.

Figure 3:
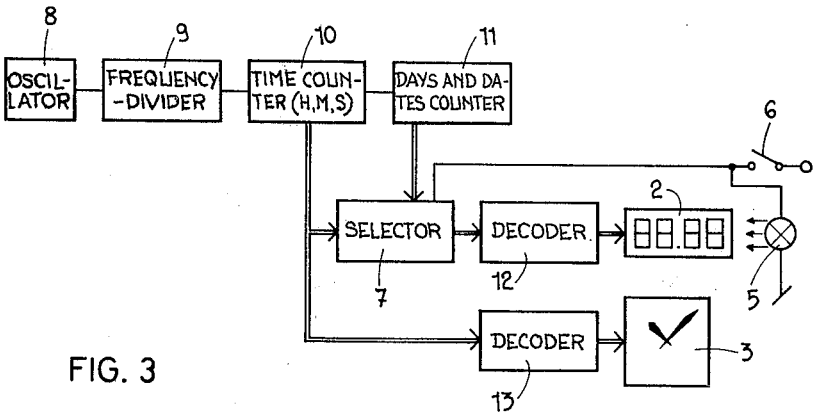
FIG. 3 shows a block electronic circuit diagram of the preferred embodiment.

The circuit illustrated in FIG. 3 comprises an oscillator 8; a frequency-divider chain 9; a time counter 10 (hours, minutes and seconds); a days and dates counter 11; the selector 7 previously described, which directs the coded information either from the counter 10 or from the counter 11 to a binary seven-segments decoder 12 which feeds the digital or numeric display device 2, depending on whether the push-button 6 is operated or not; and a binary-analog decoder 13 which constantly receives the coded information from the counter 10 for controlling the analog display cell 3.

The lighting of the lamp 5 is also controlled by the push-button 6.

In the example illustrated, the digital display cell displays the day of the week and the date when the watch is in its first operation mode (i.e. push-button 6 non-operated). It could, however, be utilised to display other information such as, for example, days and seconds, or the hours and minutes of a time-belt other than the one which is displayed by the cell 3, etc.

The two display cells 2 and 3 can be constructed entirely distinct from each other or they may form only one and the same cell, or alternatively some of their elements may be common to the two cells, such as their plates, their polarizers, or their electrodes, for example.

As previously mentioned, the illumination of the cell 2 can be by any means, for instance by an incandescent lamp or by a light-emitting diode. One could alternatively provide a permanent lighting ($\beta$-light), the control push-button 6 then serving only to control the selector 7 but not the lighting.

At last, it is to be noted that the absence of illumination of the analog display cell not only enables good display properties to be maintained during daytime readings, but also results in a reduction of the thickness of the watch, due to the fact that the illuminating device has to be accomodated within the thickness of the watch only at the level of the small display cell 2.

I claim:

1. An electronic watch comprising:

(a) means providing present time-of-day information and also other information;

(b) first passive electro-optic display means for displaying in analog form said present time-of-day information;

(c) second passive electro-optic display means for continuously displaying in digital form one of said present time-of-day information and said other information;

(d) lamp means for illuminating only said second display means;

(e) selector means for applying to said second display means either said present time-of-day information or said other information;

(f) manually operable push-button means for concurrently operating said selector means to display said present time-of-day information on said second display means and to activate said lamp means.

2. An electronic watch as defined in claim 1 wherein release of the push-button means deactivates the lamp means and causes the selector means to display said other information on said second display means.

3. An electronic watch as defined in claim 1, wherein said other information includes an indication of the day of the month.

4. An electronic watch as defined in claim 3, wherein said other information includes an indication of the day of the week.

* * * * *